US012042034B2

(12) United States Patent
Brooks

(10) Patent No.: US 12,042,034 B2
(45) Date of Patent: Jul. 23, 2024

(54) HEAT-RETAINING CLIPS FOR CREATING TEXTURED WAVES IN HAIR

(71) Applicant: Pamela J. Brooks, Cincinnati, OH (US)

(72) Inventor: Pamela J. Brooks, Cincinnati, OH (US)

( * ) Notice: Subject to any disclaimer, the term of this patent is extended or adjusted under 35 U.S.C. 154(b) by 165 days.

(21) Appl. No.: 17/450,873

(22) Filed: Oct. 14, 2021

(65) Prior Publication Data

US 2022/0110430 A1 Apr. 14, 2022

Related U.S. Application Data

(60) Provisional application No. 63/091,509, filed on Oct. 14, 2020.

(51) Int. Cl.

| | |
|---|---|
| ***A45D 2/36*** | (2006.01) |
| ***A45D 2/42*** | (2006.01) |
| ***A45D 4/16*** | (2006.01) |
| ***A45D 8/20*** | (2006.01) |

(52) U.S. Cl.

CPC ..... *A45D 2/362* (2013.01); *A45D 2/42* (2013.01); *A45D 4/16* (2013.01); *A45D 8/20* (2013.01)

(58) Field of Classification Search

CPC ..... A45D 2/236; A45D 2/367; A45D 2/36; A45D 2/2421; A45D 2/2414; A45D 2/141; A45D 2/145; A45D 2/2471; A45D 4/085; A45D 4/12; A45D 4/14; A45D 4/16;

(Continued)

(56) References Cited

U.S. PATENT DOCUMENTS

| | | | | |
|---|---|---|---|---|
| 2,621,664 A | | 12/1952 | Leclabart | |
| 2,788,007 A | * | 4/1957 | Bogardy | A45D 8/20 132/223 |
| 3,575,182 A | | 4/1971 | Leclabart | |

(Continued)

FOREIGN PATENT DOCUMENTS

| | | | | |
|---|---|---|---|---|
| KR | 20150014675 A | * | 2/2015 | A45D 6/14 |
| KR | 20160002450 U | * | 7/2016 | A45D 2/122 |

OTHER PUBLICATIONS

Thermal Conductivity, http://hyperphysics.phy-astr.gsu.edu/hbase/Tables/thron.html (Year: 2023).*

(Continued)

*Primary Examiner* — Tatiana L Nobrega
(74) *Attorney, Agent, or Firm* — Dunlap Bennett & Ludwig, PLLC

(57) ABSTRACT

A heat-retaining clip assembly is provided. The heat-retaining clip assembly includes a convex surface nested in a concave surface in a closed position, wherein the convex and concave surfaces are pivotably connected to move between the closed position and an open position. The convex surface has a higher thermal conductivity than the concave surface. The present invention includes a system providing an arcuate heating element that can be sandwiched between the convex and concave surfaces in the closed position, while the convex surface conducts most of the heat. Then the heat-retaining clip assembly may be moved in the open position from the heating element to a user's hair so that the heat stored in the convex surface transfers to the hair to form textured waves in the hair after the clip is moved back to the closed position.

6 Claims, 4 Drawing Sheets

(58) Field of Classification Search
CPC ... A45D 6/16; A45D 6/08; A45D 6/10; A45D 6/145; A45D 1/20
See application file for complete search history.

(56) References Cited

U.S. PATENT DOCUMENTS

| | | | | | |
|---|---|---|---|---|---|
| 3,701,882 | A * | 10/1972 | Wada | A45D 1/20 | 132/229 |
| 4,829,155 | A * | 5/1989 | Fukutaka | A45D 4/10 | 132/118 |
| 5,294,777 | A * | 3/1994 | Denhup | A45D 8/24 | 132/229 |
| 5,522,407 | A * | 6/1996 | Kelsey | A45D 4/16 | 132/234 |
| 7,516,745 | B2 | 4/2009 | Maione et al. | | |
| 8,327,860 | B2 * | 12/2012 | Flowers | A45D 7/02 | 132/233 |
| 8,474,465 | B2 | 7/2013 | Daley | | |
| D700,740 | S | 3/2014 | Cheung | | |
| 8,912,467 | B2 | 12/2014 | Oishi et al. | | |
| 2009/0165811 | A1 | 7/2009 | Zimmerman | | |
| 2010/0116285 | A1 | 5/2010 | Ham | | |
| 2010/0116286 | A1 | 5/2010 | ORourke | | |
| 2013/0152961 | A1 | 6/2013 | Sinnott | | |
| 2014/0116461 | A1 | 5/2014 | Oishi et al. | | |
| 2014/0123995 | A1 | 5/2014 | Cheung et al. | | |
| 2014/0166037 | A1 | 6/2014 | Renfro | | |
| 2019/0133286 | A1 | 5/2019 | Kuzia, Jr. | | |
| 2021/0353025 | A1 * | 11/2021 | Weddles | A45D 8/24 | |

OTHER PUBLICATIONS

Plastics—Thermal Conductivity Coefficients, https://www.engineeringtoolbox.com/thermal-conductivity-plastics-d_1786.html (Year: 2023).*

* cited by examiner

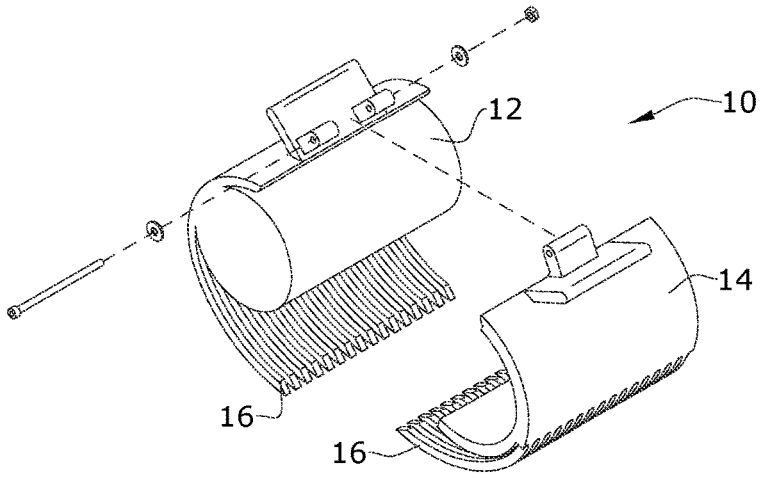
FIG.5
FIG.6
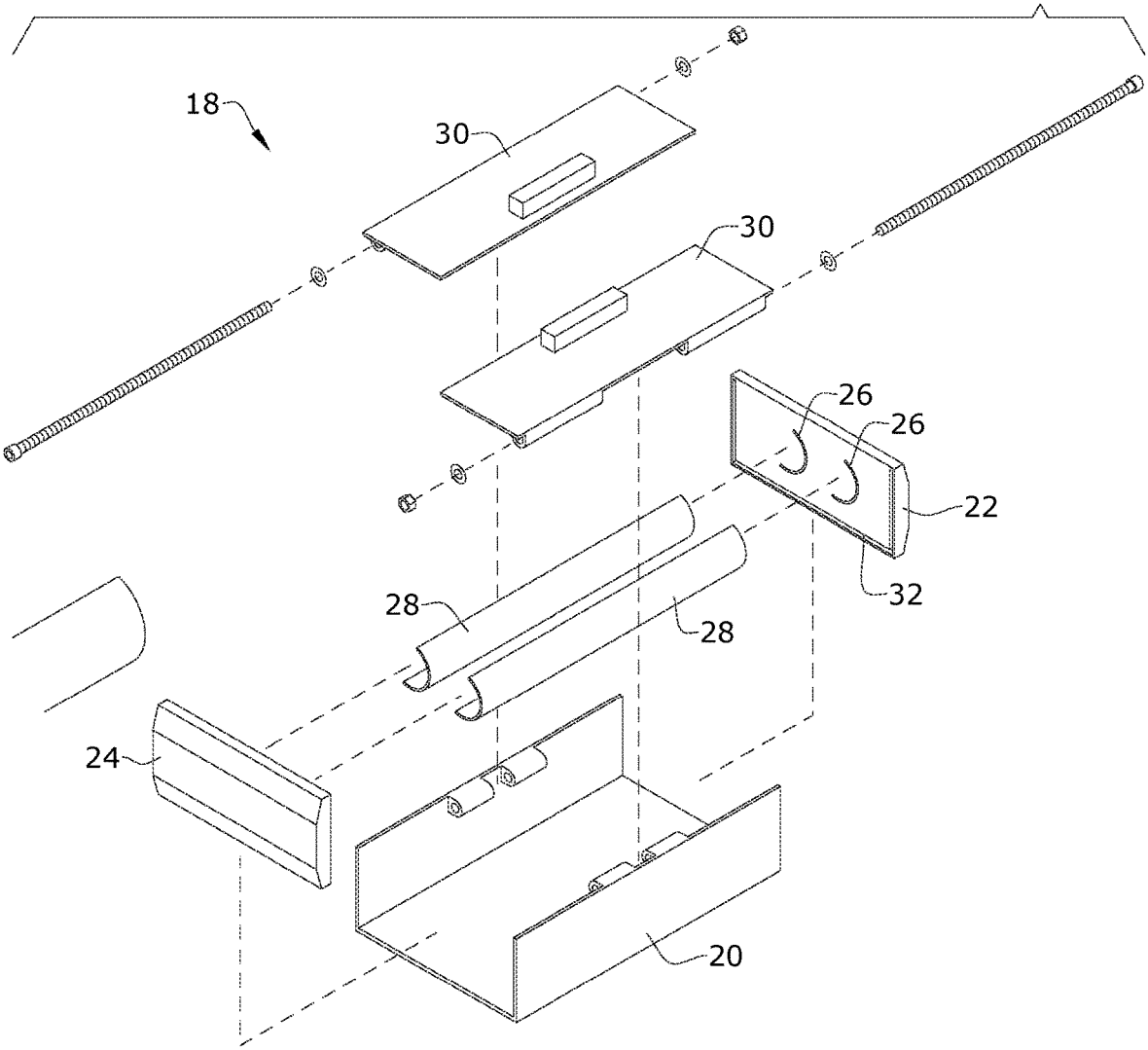

HEAT-RETAINING CLIPS FOR CREATING TEXTURED WAVES IN HAIR

CROSS-REFERENCE TO RELATED APPLICATION

This application claims the benefit of priority of U.S. provisional application No. 66/091,509, filed 14 Oct. 2020, the contents of which are herein incorporated by reference.

BACKGROUND OF THE INVENTION

The present invention relates to hair curling devices and more particularly, to a heat-retaining clip assembly adapted to create textured waves in hair.

Styling hair can be cumbersome when using a curling iron or a hot roller. For instance, the curling iron requires continually turning and twisting of the iron to fashion the hair—while working from one's reflection in a mirror—and as a result it is not uncommon for users to make mistakes wielding the curling iron. Some of these mistakes can result in the user burning themselves. The other option for rolling one's hair into curls is to use a hot roller. Hair rollers, however, need two items to work and only offer an old-fashioned style of curl. Hair rollers need two separate portions: a tubular portion and separate clip portion, wherein the clip portion secures the tubular portion to the hair. This too can be unwieldy when working from the reflection of a mirror.

Besides the above-mentioned manipulating problems, women who have shoulder and arm pain have difficulty holding the curling irons or rollers (to engage the clip portion to the tubular portion) up above their head for the necessary time. Accordingly, there is a need for heat-retaining clips adapted to create textured waves in the hair. No other tool has the design for heat retaining clips as those embodied in the present invention, colloquially known as "Hot Clips". Simply put, the heat retaining clips sit in a heating unit. The hair may or may not be twisted prior to the retaining clips being taken from a housing unit and single-handedly placed in the hair in a matter of seconds.

The heat retaining clips have a concave and convex center that heats up and is surrounded by a heat resistant clip that has teeth for securing the concave and convex center to the hair.

As mentioned above, in some embodiments, a user can employ the heat-retaining clips single-handedly so that they may twist the hair prior with the other hand during placement of the heat-retaining clips.

SUMMARY OF THE INVENTION

In one aspect of the present invention, a heat-retaining clip assembly for curling hair, the assembly includes: a convex surface pivotably connected to a concave surface so said surfaces are movable between an open position and a closed position; and the convex surface having a first thermal conductivity at least three times that of a second thermal conductivity of the concave surface.

In another aspect of the present invention, the heat-retaining clip assembly further includes a first radius of curvature of the convex surface is less than a second radius of curvature of the concave surface, so that in the closed condition the convex surface and the concave surface nest in a concentrically spaced apart condition, wherein the convex surface is a portion of a cylindrical body, and wherein the concave surface is a portion of an arcuate body; and further includes first and second pluralities of teeth associated with the convex and concave surfaces, respectively, so that in the closed position the first and second pluralities of teeth enmesh, and so that in the open position there is a gap between distal ends of the first and second pluralities of teeth.

In yet another aspect of the present invention, a system for curling hair, the system includes the following: one or more heat-retaining clip assembly for curling hair, each heat-retaining clip assembly having a convex surface pivotably connected to a concave surface so said surfaces are movable between an open position and a closed position; and the convex surface having a first thermal conductivity at least three times that of a second thermal conductivity of the concave surface, wherein a first radius of curvature of the convex surface is less than a second radius of curvature of the concave surface, so that in the closed condition the convex surface and the concave surface nest in a concentrically spaced apart condition; and one or more arcuate heating element having a third radius of curvature less than the second radius of curvature and greater than the first radius of curvature so that in the closed condition the heat-retaining clip assembly sandwiches the heating element between the convex surface and the concave surface.

In still yet another aspect of the present invention, the heat-retaining clip assembly includes a first curved base pivotably connected to a second curved base so said curved bases are movable between an open position and a closed position; a first plurality of curved teeth extending from a distal edge of the first curved base; a cylindrical body circumferentially joined to an inner surface of the first curved base; a second plurality of curved teeth extending from a distal edge of the second curved base so that the first and second pluralities of curved teeth enmesh in the closed position; and an arcuate body circumferentially joined to an inner surface of the second curved base so that in the closed position a convex surface of the cylindrical body is concentrically spaced apart from a concave surface of the arcuate body, whereby said concentrically spaced apart relationship of the convex and concave surfaces in the closed position enables the convex and concave surfaces to sandwich an arcuate heating element and, separately, a lock of hair.

These and other features, aspects and advantages of the present invention will become better understood with reference to the following drawings, description and claims.

BRIEF DESCRIPTION OF THE DRAWINGS

FIG. 5 is an exploded perspective view of an exemplary embodiment of the present invention.

FIG. 6 is an exploded perspective view of an exemplary embodiment of the present invention.

DETAILED DESCRIPTION OF THE INVENTION

Figure 1:
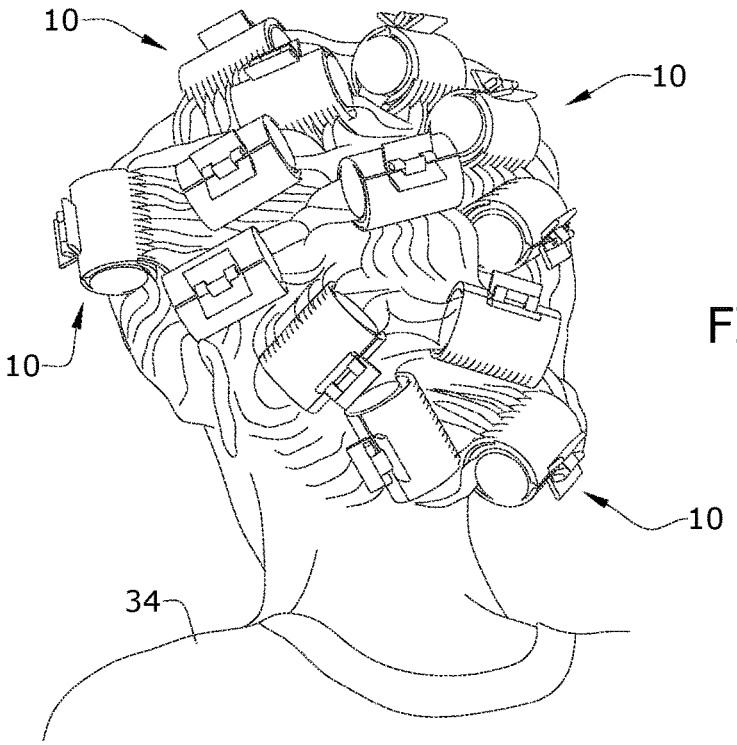
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a heat-retaining clip assembly providing a convex surface nested in a concave surface in a closed position, wherein the convex and concave surfaces are pivotably connected to move between the closed position and an open position. The convex surface has a higher thermal conductivity than the concave surface. The present invention includes a system providing an arcuate heating element that can be sandwiched between the convex and concave surfaces in the closed position, while the convex surface conducts most of the heat. Then the heat-retaining clip assembly may be moved in the open position from the heating element to a user's hair so that the heat stored in the convex surface transfers to the hair to form textured waves in the hair after the clip is moved back to the closed position.

Referring to FIGS. 1 through 7, the present invention may include a heat-retaining clip assembly 10. The heat-retaining clip assembly 10 may have a first portion 12 pivotably connected to a second portion 14 in such a way that the heat-retaining clip assembly 10 is movable between an open position and a closed position. The pivotable connection 40 may be, but is not limited to, a hinge. The pivotable connection 40 may provide arms or levers 42 to effectuate the pivotable movement.

The first portion 12 may include a cylindrical body 13. The second portion 14 may include an arcuate body 15 having a radius of curvature greater than the radius of the cylindrical body 13. The (radius of curvature of the) arcuate body 15 may curve for approximately 180 degrees. It may be said that the cylindrical body 13 provides a convex surface 131 that complements the inner, concave surface 151 of the arcuate body 15 so that those two surfaces nest in the closed position.

The material of at least the cylindrical body 13 has a thermal conductivity—Watts per meter per degree Kelvin (W/mK)— that may be in excess of 200 W/mK, providing sufficient thermal retention to create textured waves in hair. The arcuate body 15, on the other hand, may have a significantly lower thermal conductivity, below 200 W/mK, and may be thermal insulators. As a result, if the cylindrical body 13 and the arcuate body 15 are both thermally engaging a heating element, the cylindrical body 13 conducts and retains a significant amount of the heat of the heating element. In other embodiments, the arcuate body 15 may have a similar thermal conductivity as the cylindrical body 13, which may facilitate some forms or fashions of textured waves in hair.

First and second pluralities of teeth elements 16 may circumferentially extend from each the cylindrical body 13 and an outer surface of the arcuate body 15, respectively. The separate first and second pluralities of teeth elements 16 are spaced apart to mesh in the closed position, as illustrated in FIG. 3. The teeth elements 16 may be curved and extend so as to enmesh in the closed position though provide a gap between the separate first and second pluralities of teeth elements 16 in the open position, as illustrated in FIG. 2, so that hair or other objects can pass therebetween.

The present disclosure contemplates a systemic heating element 28 housed in a housing assembly 18. The heating element 28 may be shaped so as to be approximately coextensive with the arcuate body 15 or at least its concave surface 15. The arcuate heating elements 28 may have a radius of curvature less than the radius of curvature less of the concave surface 151 but greater than the radius of the convex surface 131 of the cylindrical body 13, so that in the closed position the concave surface 151 and the convex surface 131 sandwich the heating element 28.

Figure 2:
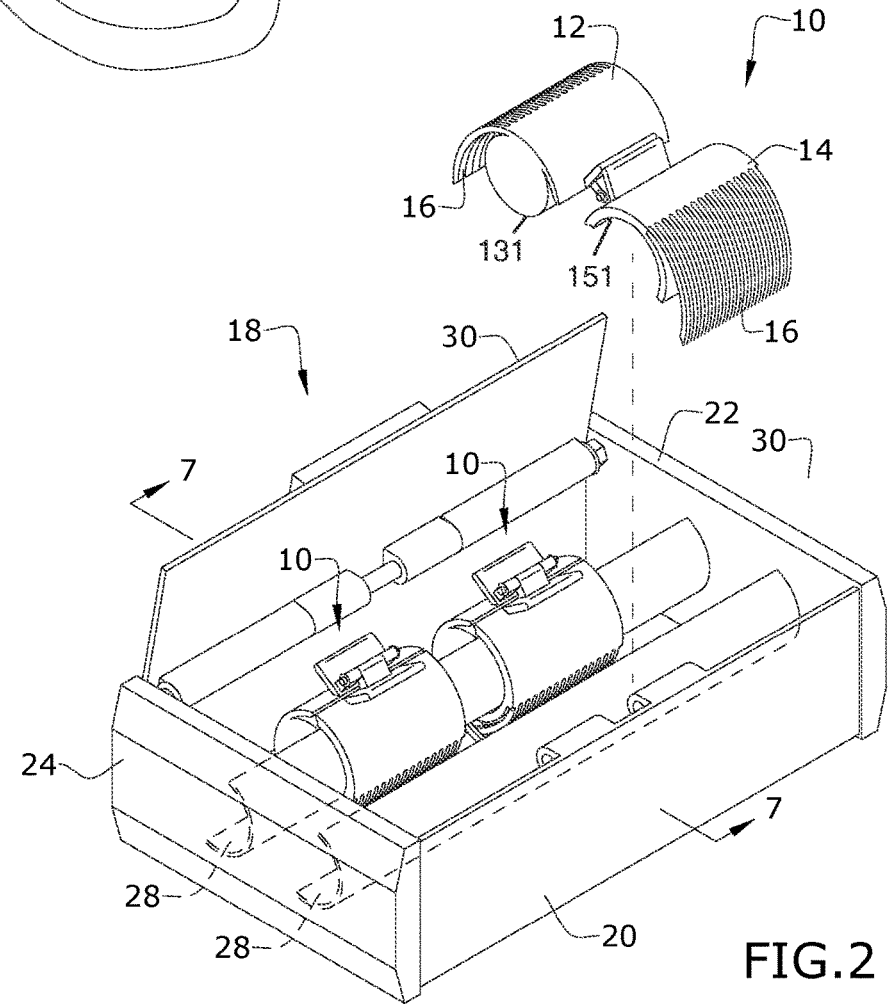
FIG. 2 is a perspective view of an exemplary embodiment of the present invention, shown with housing unit and right lid door 30 omitted for clarity.
Figure 3:
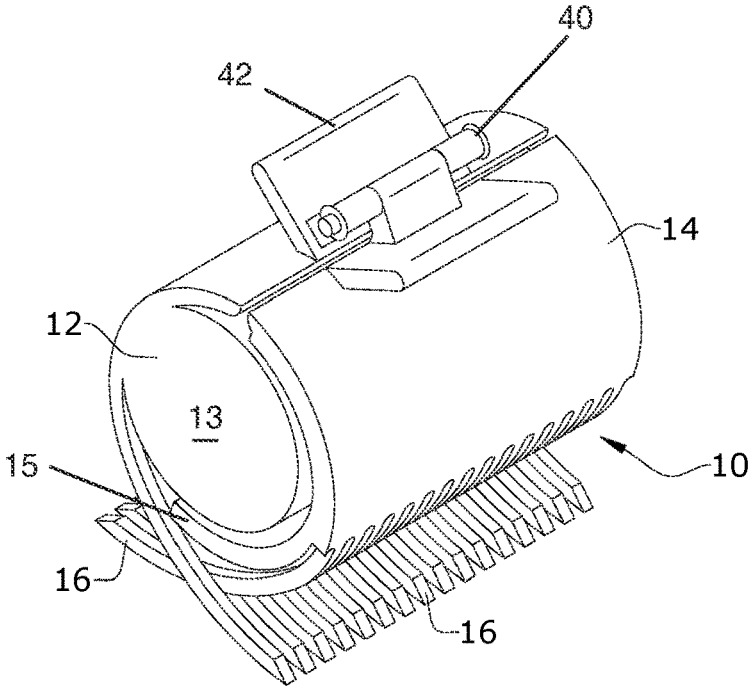
FIG. 3 is a perspective view of an exemplary embodiment of the present invention.
Figure 4:
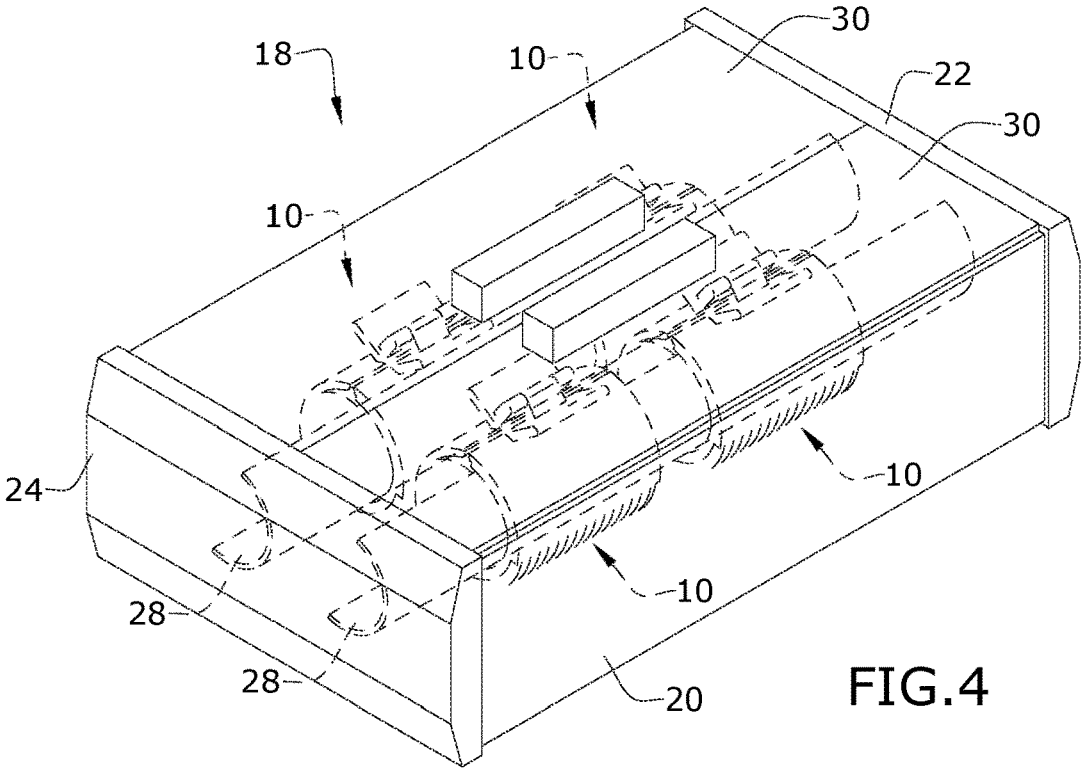
FIG. 4 is a perspective view of an exemplary embodiment of the housing unit of the present invention, shown in a closed condition.
Figure 7:
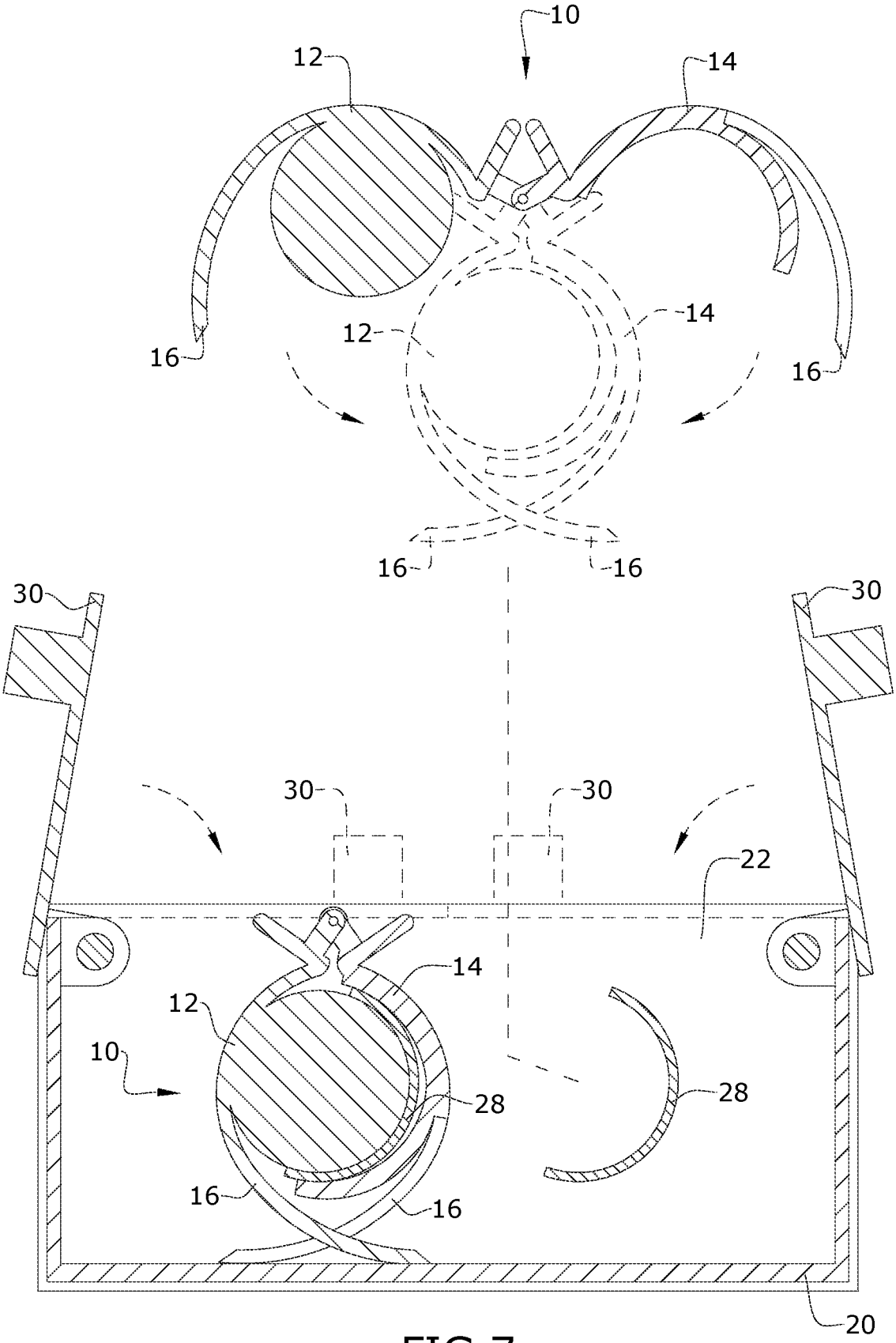
FIG. 7 is an exploded section view of an exemplary embodiment of the present invention, taken along line 7-7 in FIG. 2.

The housing element 18 may support more than one heating element 28, as illustrated in FIG. 2. The housing element 18 may have opposing end walls 22 and 24 providing arcuate openings 26 or retaining the distal ends of each heating element 28. The housing element 18 may also have a shell 20 that joins to the end walls 22 and 24 (by way of a connection 32) to define an enclosure for the one or more heating elements 28. Lid doors 30 may pivotably connect to the shell 20 to close off the enclosure.

The housing element 18 and its components may be heat resistant plastics or the like having a low thermal conductivity or be thermal insulators. The pluralities of teeth elements 16 and the hinge levers 42 may also have low thermal conductivity and be thermal insulators.

A method of using the present invention may include the following. The heat-retaining clip assembly 10 and the housing assembly 18 disclosed herein may be provided. A user 34 may have the convex surface 131 and the concave surface 151 sandwich the heating element 28 in the closed position prior to use when the heating element is generating heat, which is conducted primarily in the convex surface 131 with the high thermal conductivity. Then the user 34 moves the retaining clip assembly 10 to the open position to disengage the heating element 28 and single-handedly place it in their hair to create the textured ways by moving the retaining clip assembly 10 back to the closed condition for a sufficient amount of time.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A heat-retaining clip assembly for curling hair, the assembly comprising:

a first curved base pivotably connected to a second curved base so said curved bases are movable between an open position and a closed position;

a first plurality of curved teeth extending from a distal edge of the first curved base;

a cylindrical body circumferentially joined to an inner surface of the first curved base;

a second plurality of curved teeth extending from a distal edge of the second curved base so that the first and second pluralities of curved teeth enmesh in the closed position; and an arcuate body circumferentially joined to an inner surface of the second curved base so that in the closed position a convex surface of the cylindrical body is concentrically spaced apart from a concave surface of the arcuate body, whereby said concentrically spaced apart relationship of the convex and concave surfaces in the closed position enables the convex and concave surfaces to sandwich an arcuate heating element and, separately, a lock of hair.

2. The assembly of claim 1, wherein the open position there is a gap between distal ends of the first and second pluralities of curved teeth.

3. A system for curling hair, the system comprising:

one or more heat-retaining clip assemblies of claim 1;

one or more arcuate heating elements having a radius of curvature so that in the closed condition the heat-retaining clip assemblies sandwich the heating elements in a nested condition between the convex surface and the concave surface;

a housing element dimensioned and shaped to house the one or more heat-retaining clip assemblies and the one of more arcuate heating elements in the nested condition; and the housing element having an end wall providing an arcuate opening for each arcuate heating element, wherein the arcuate heating element projects form the arcuate opening so as to enable the nested condition.

4. The assembly of claim 1, wherein a first radius of curvature of the convex surface is less than a second radius of curvature of the concave surface.

5. The assembly of claim 1, wherein the pivotable connection includes a hinge and levers extending from the first and second curved bases to effectuate the pivotable movement.

6. The assembly of claim 1, wherein the convex surface has a first thermal conductivity greater than a second thermal conductivity of the concave surface.

* * * * *